US005868123A

United States Patent [19]

Hasegawa et al.

[11] Patent Number: 5,868,123

[45] Date of Patent: Feb. 9, 1999

[54] MAGNETIC CORE-COIL ASSEMBLY FOR SPARK IGNITION SYSTEMS

[75] Inventors: Ryusuke Hasegawa, Morristown; John Silgailis, Cedar Grove, both of N.J.; Donald Grimes, Findley, Ohio

[73] Assignee: AlliedSignal Inc., Morris Township, N.J.

[21] Appl. No.: 672,909

[22] Filed: Jun. 28, 1996

Related U.S. Application Data

[60] Provisional application No. 60/004,815 Oct. 5, 1995.

[51] Int. Cl.[6] ..... F02D 3/02

[52] U.S. Cl. ..... 123/634

[58] Field of Search ..... 123/634, 635

[56] References Cited

U.S. PATENT DOCUMENTS

| | | | |
|---|---|---|---|
| 4,502,454 | 3/1985 | Hamai et al. | 123/634 X |
| 5,377,652 | 1/1995 | Noble et al. | 123/634 |
| 5,456,241 | 10/1995 | Ward | 123/637 X |

*Primary Examiner*—Tony M. Argenbright
*Attorney, Agent, or Firm*—Ernest D. Buff

[57] ABSTRACT

A magnetic core-coil assembly generates an ignition event in a spark ignition internal combustion system having at least one combustion chamber. The assembly comprises a magnetic core of amorphous metal having a primary coil for low voltage excitation and a secondary coil for a high voltage output to be fed to a spark plug. A high voltage is generated in the secondary coil within a short period of time following excitation thereof. The assembly senses spark ignition conditions in the combustion chamber to control the ignition event.

7 Claims, 4 Drawing Sheets

MAGNETIC CORE-COIL ASSEMBLY FOR SPARK IGNITION SYSTEMS

BACKGROUND OF THE INVENTION

Cross Reference to Related Applications

This application claims the benefit of U.S. Provisional Application No. 60/004,815, filed Oct. 5, 1995.

1. Field of the Invention

This invention relates to spark ignition systems for internal combustion engines; and more particularly to a spark ignition system which improves performance of the engine system and reduces the size of the magnetic components in the spark ignition transformer.

2. Description of the Prior Art

In a spark-ignition internal combustion engine, a flyback transformer is commonly used to generate the high voltage needed to create an arc across the gap of the spark plug igniting the fuel and air mixture. The timing of this ignition spark event is critical for best fuel economy and low exhaust emission of environmentally hazardous gases. A spark event which is too late leads to loss of engine power and loss of efficiency. A spark event which is too early leads to detonation, often called "ping" or "knock", which can, in turn, lead to detrimental pre-ignition and subsequent engine damage. Correct spark timing is dependent on engine speed and load. Each cylinder of an engine often requires different timing for optimum performance. Different spark timing for each cylinder can be obtained by providing a spark ignition transformer for each spark plug.

To improve engine efficiency and alleviate some of the problems associated with inappropriate ignition spark timing, some engines have been equipped with microprocessor-controlled systems which include sensors for engine speed, intake air temperature and pressure, engine temperature, exhaust gas oxygen content, and sensors to detect "ping" or "knock". A knock sensor is essentially an electro-mechanical transducer whose sensitivity is not sufficient to detect knock over the whole range of engine speed and load. The microprocessor's determination of proper ignition spark timing does not always provide optimum engine performance. A better sensing of "knock" is needed.

A disproportionately greater amount of exhaust emission of hazardous gases is created during the initial operation of a cold engine and during idle and off-idle operation. Studies have shown that rapid multi-sparking of the spark plug for each ignition event during these two regimes of engine operation reduces hazardous exhaust emissions. Accordingly, it is desirable to have a spark ignition transformer which can be charged and discharged very rapidly.

A coil-per-spark plug (CPP) ignition arrangement in which the spark ignition transformer is mounted directly to the spark plug terminal, eliminating a high voltage wire, is gaining acceptance as a method for improving the spark ignition timing of internal combustion engines. One example of a CPP ignition arrangement is that disclosed by U.S. Pat. No. 4,846,129 dated Jul. 11, 1989 (hereinafter "the Noble patent"). The physical diameter of the spark ignition transformer must fit into the same engine tube in which the spark plug is mounted. To achieve the engine diagnostic goals envisioned in the Noble patent, the patentee discloses an indirect method utilizing a ferrite core. Ideally the magnetic performance of the spark ignition transformer is sufficient throughout the engine operation to sense the sparking condition in the combustion chamber. Clearly, a new type of ignition transformer is needed for accurate engine diagnosis.

Engine misfiring increases hazardous exhaust emissions. Numerous cold starts without adequate heat in the spark plug insulator in the combustion chamber can lead to misfires, due to deposition of soot on the insulator. The electrically conductive soot reduces the voltage increase available for a spark event. A spark ignition transformer which provides an extremely rapid rise in voltage can minimize the misfires due to soot fouling.

To achieve the spark ignition performance needed for successful operation of the ignition and engine diagnostic system disclosed by Noble and, at the same time, reduce the incidence of engine misfire due to spark plug soot fouling, the spark ignition transformer's core material must have certain magnetic permeability, must not magnetically saturate during operation, and must have low magnetic losses. The combination of these required properties narrows the availability of suitable core materials. Considering the target cost of an automotive spark ignition system, possible candidates for the core material include silicon steel, ferrite, and iron-based amorphous metal. Conventional silicon steel routinely used in utility transformer cores is inexpensive, but its magnetic losses are too high. Thinner gauge silicon steel with lower magnetic losses is too costly. Ferrites are inexpensive, but their saturation inductions are normally less than 0.5 T and Curie temperatures at which the core's magnetic induction becomes close to zero are near 200° C. This temperature is too low considering that the spark ignition transformer's upper operating temperature is assumed to be about 180° C. Iron-based amorphous metal has low magnetic loss and high saturation induction exceeding 1.5 T, however it shows relatively high permeability. An iron-based amorphous metal capable of achieving a level of magnetic permeability suitable for a spark ignition transformer is needed.

SUMMARY OF THE INVENTION

The present invention provides a magnetic core for a coil-per-plug (CPP) spark ignition transformer which generates a rapid voltage rise and a signal that accurately portrays the voltage profile of the ignition event. The core is composed of an amorphous ferromagnetic material which exhibits low core loss and low permeability (ranging from about 100 to 300). Such magnetic properties are especially suited for rapid firing of the plug during a combustion cycle. Misfires of the engine due to soot fouling are minimized. Moreover, energy transfer from coil to plug is carried out in a highly efficient manner, with the result that very little energy remains within the core after discharge. This high efficiency energy transfer enables the core to monitor the voltage profile of the ignition event in an accurate manner. When the magnetic core material is wound into a cylinder upon which the primary and secondary wire windings are laid to form a toroidal transformer, the signal generated provides a much more accurate picture of the ignition voltage profile than that produced by cores exhibiting higher magnetic losses.

The magnetic core according to the present invention is based on an amorphous metal with a high magnetic induction, which includes iron-base alloys. Two basic forms of a core are disclosed. They are gapped and non-gapped. The gapped core has a discontinuous magnetic section in a magnetically continuous path. An example of such a core is a toroidal-shaped magnetic core having a small slit commonly known as an air-gap. The gapped configuration is adopted when the needed permeability is considerably lower than the core's own permeability as wound. The air-gap portion of the magnetic path reduces the overall permeability. The non-gapped core has a magnetic permeability similar to that of an air-gapped core, but is physically continuous, having a structure similar to that typically found in a toroidal magnetic core. The apparent presence of an air-gap uniformly distributed within the non-gapped core gives rise to the term "distributed-gap-core".

The gapped-core of the present invention has an overall magnetic permeability between about 100 and about 300 as measured at a frequency of about 1 kHz. The raw core material can have a permeability much higher than 100–300 level, but through special processing, the permeability can be reduced to the desired range without adversely affecting the other needed qualities of the iron-base amorphous alloy. An output voltage greater than 10 kV for spark ignition is achieved with less than 120 ampere-turns of primary and approximately 110 to 160 turns of secondary winding.

The non-gapped core of the present invention is made of an amorphous metal based on iron alloys and processed so that the core's magnetic permeability is between 100 and 300 as measured at a frequency of approximately 1 kHz. To improve the efficiency of non-gapped cores by reducing the eddy current losses, shorter cylinders are wound and processed and stacked end to end to obtain the desired amount of magnetic core. Leakage flux from a distributed-gap-core is much less than that from a gapped-core, emanating less undesirable radio frequency interference into the surroundings. Furthermore, because of the closed magnetic path associated with a non-gapped core, signal-to-noise ratio is larger than that of a gapped-core, making the non-gapped core especially well suited for use as a signal transformer to diagnose engine combustion processes. An output voltage at the secondary winding greater than 10 kV for spark ignition is achieved by a non-gapped core with less than 120 ampere-turns of primary and about 110 to 160 turns of secondary winding.

BRIEF DESCRIPTION OF THE DRAWING

The invention will be more fully understood and further advantages will become apparent when reference is made to the following detailed description of the preferred embodiments of the invention and the accompanying drawings, in which.

DESCRIPTION OF THE PREFERRED EMBODIMENTS

Magnetic cores composed of an iron-based amorphous metal having a saturation induction exceeding 1.5 T in the as-cast state were prepared. The cores had a cylindrical form with a cylinder height of about 80 mm and outside and inside diameters of about 17 and 12 mm, respectively. These cores were heat-treated with no external applied fields. Air gaps were introduced into some of the cores by cutting out some part of the cores along the cylinder axes. By keeping the total cylinder height at about 80 mm, some cores were segmented into two and five sections, each section having a subcylindrical core height of about 40 and 16 mm, respectively. Several turns and 110 to 160 turns of copper windings were applied to each of the cores as the primary and secondary coil, respectively. Plastic covering was placed over the core so that the wires were not near the core. The transformer wiring and core were then vacuum-cast in epoxy for high voltage dielectric integrity. A current was supplied in the primary coil, building up rapidly within about 25 to 100 μsec to a level exceeding 100 amps.

Figure 1:
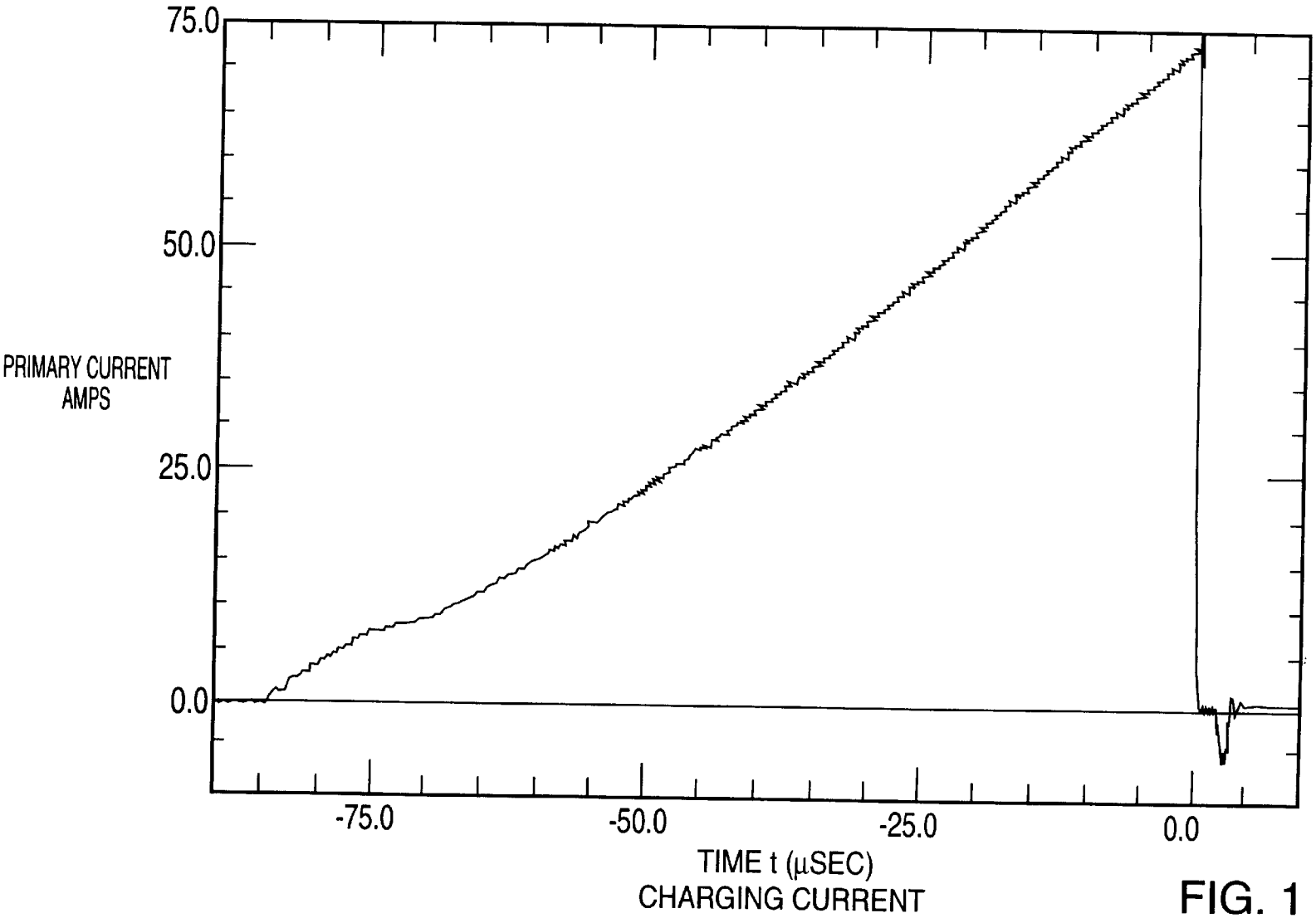
FIGS. 1, 2 and 3 show a typical increase in primary current when the power is turned on and then off, the primary voltage being on the switched ground side, and the higher voltage being on the secondary side of the transformer, respectively.
Figure 2:
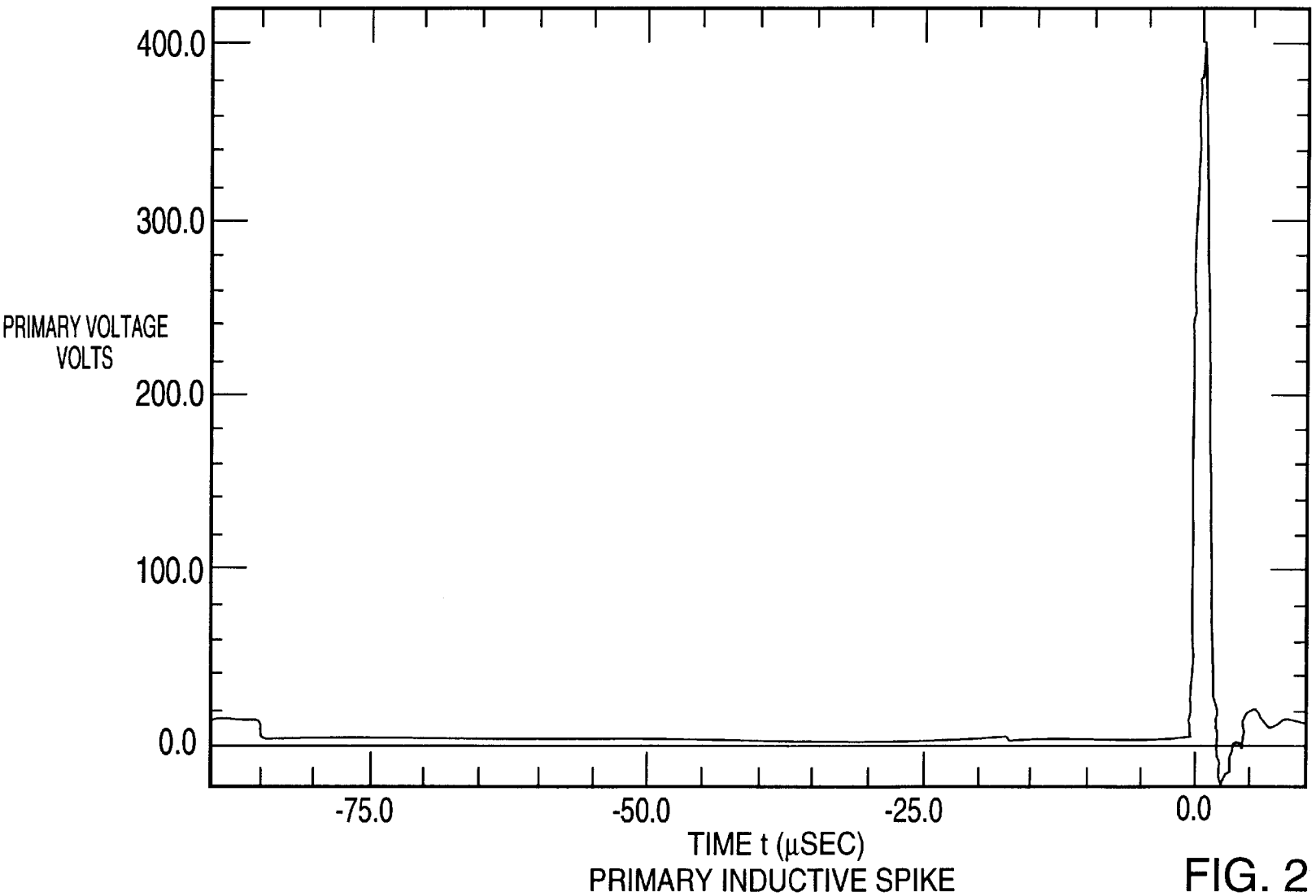

The curve in FIG. 1 indicates the current build-up starting at about 85 μsec prior to switching-off (corresponding to t=−85 μsec in FIG. 1 ). During the current ramp-up, the voltage across the primary winding is close to zero as shown in FIG. 2. At t=0, the primary current is cut off, which results in a large magnetic flux change, generating a large voltage in the secondary coil. The voltage profiles in the primary and secondary coils are represented by the curves in FIGS. 2 and 3, respectively. These voltage profiles are readily displayed using an oscilloscope of the conventional type. It is noted that the high voltage in the secondary coil is generated within a short period of time, typically less than 5 μsec. Thus, in the magnetic cores of the present invention, a high voltage, exceeding 10 kV, can be repeatedly generated at time intervals of less than 100 μsec. This feature is required to achieve the rapid multiple sparking action mentioned above. Moreover, the rapid voltage rise produced in the secondary winding reduces engine misfires resulting from soot fouling.

Figure 3:
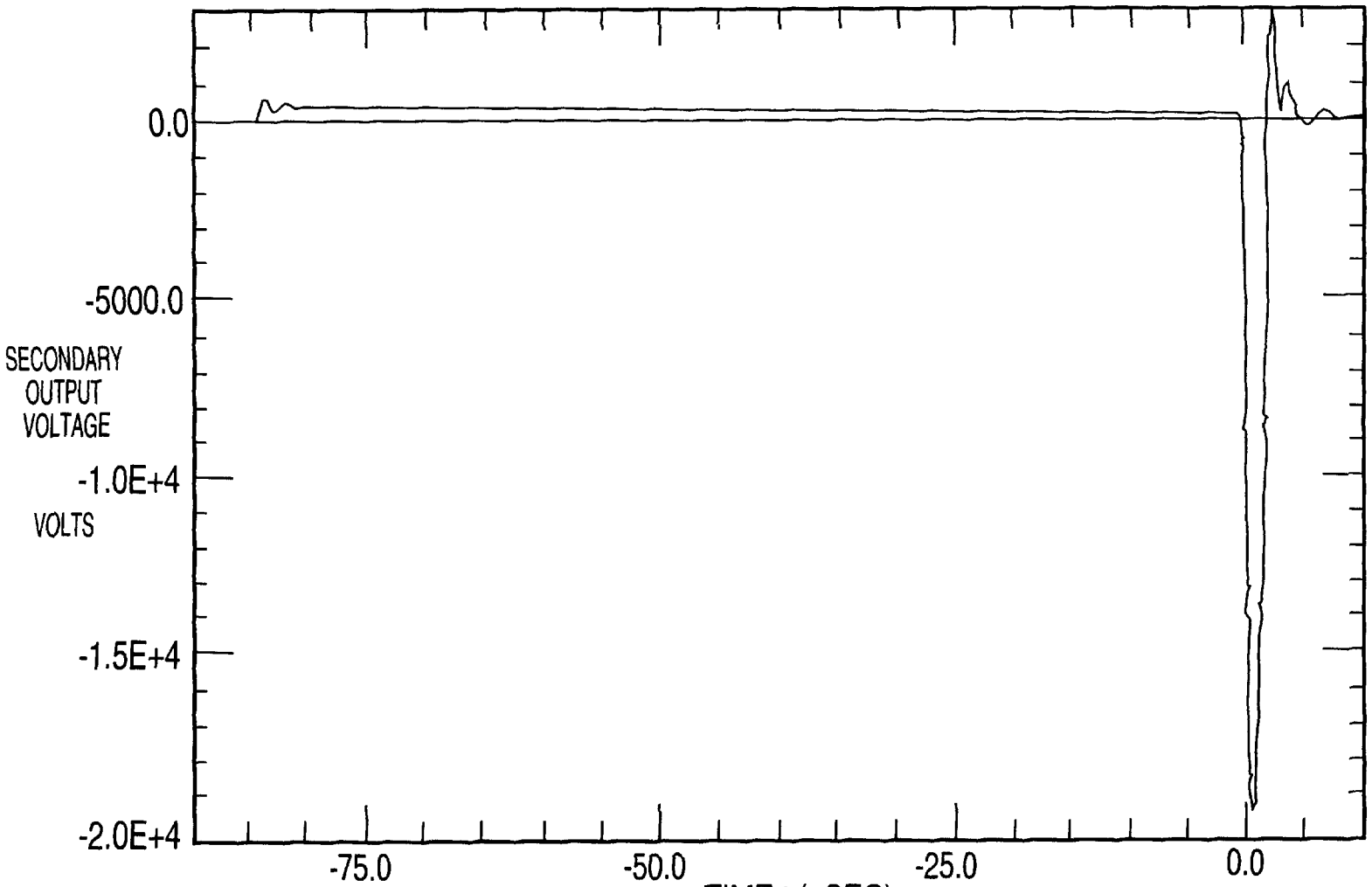

In addition to the advantages relating to spark ignition event described above, the core-coil assembly of the present invention serves as an engine diagnostic device. Because of the low magnetic losses of the magnetic core of the present invention, the primary voltage profile of FIG. 2 reflects faithfully what is taking place in the secondary winding as depicted in FIG. 3. After each spark ignition, the primary voltage such as shown in FIG. 2 is analyzed for proper ignition characteristics, and the resulting data are then fed to the ignition system control. The present core-coil assembly thus eliminates the additional magnetic element required by the system disclosed in the Noble patent, wherein the core is composed of a ferrite material.

The following examples are presented to provide a more complete understanding of the invention. The specific techniques conditions, materials, proportions and reported data set forth to illustrate the principles and practice of the invention are exemplary and should not be construed as limiting the scope of the invention.

EXAMPLE 1

Figure 4B:
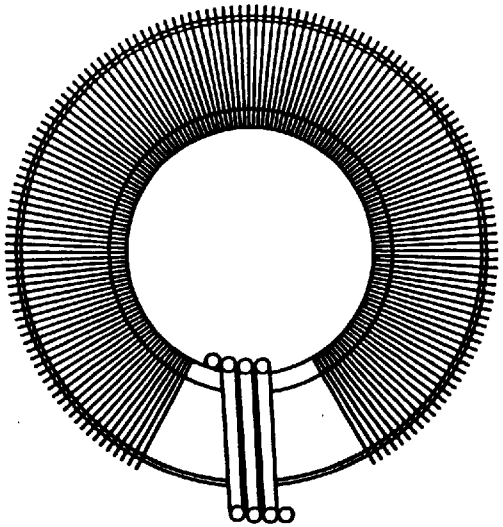
FIGS. 4*a* and 4*b* are side and top views, respectively, of the core-coil assembly of the present invention.
Figure 4A:
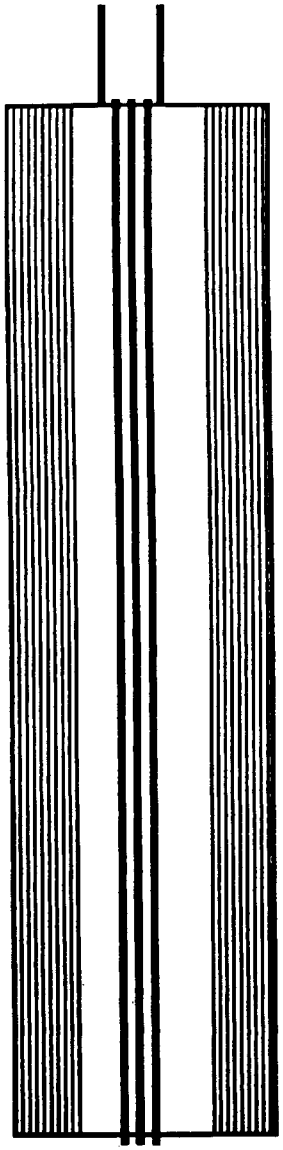

An amorphous iron-based ribbon having a width of about 80 mm and a thickness of about 20 μm was wound on a machined stainless steel mandrel. The inside diameter of 12 mm was set by the mandrel and the outside diameter was selected to be 17 mm. The finished cylindrical core weighed about 50–60 grams. The cores were annealed in a nitrogen atmosphere in the 430° to 450° C. range with soak times from 2 to 16 hours. The annealed cores were wound with 2–4 turns of heavy gauge insulated copper wire as the primary coil and with 150 turns of thin gauge insulated copper wire as the secondary coil. The core-coil shown at FIGS. 4*a* and 4*b*, was epoxy-potted. With this configuration, the secondary voltage was measured as a function of the primary current, and is set forth below in Table 1.

TABLE I

| Primary Current (amp-turn) | Secondary Voltage (k V) |
|---|---|
| 40 | 4.8 |
| 80 | 9.0 |
| 120 | 12.8 |
| 160 | 16.0 |
| 200 | 18.8 |
| 240 | 20.4 |
| 280 | 22.0 |

Secondary voltages exceeding 12 and 22 kV were obtained with primary currents of about 120 and 280 amp·turns, respectively.

EXAMPLE 2

Two 40 mm high cylindrical cores were prepared following the process given in Example 1 and were placed sideby-side to form a 80-mm-high single magnetic core. The primary and secondary coils were wound identically to the core-coil assembly of Example 1. The secondary voltage versus primary current obtained is set forth below in Table II:

TABLE II

| Primary Current (amp-turn) | Secondary Voltage (k V) |
|---|---|
| 40 | 4.2 |
| 80 | 8.4 |
| 160 | 14.2 |
| 240 | 18.5 |
| 320 | 21.6 |
| 400 | 23.1 |

Secondary voltages exceeding 14 and 23 kV were attained with primary currents of about 160 and 400 amp·turns, respectively.

EXAMPLE 3

Five 15.6 mm high toroidal cores were prepared following the process of Example 1 and were assembled to form a single cylindrical core of about 80 mm in height. The core-coil assembly was substantially identical to that of Example 1, except that the secondary coil had 138 turns. The secondary voltage as a function of the primary current is set forth below in Table III:

TABLE III

| Primary Current (amp-turn) | Secondary Voltage (k V) |
|---|---|
| 40 | 5.4 |
| 80 | 10.2 |
| 160 | 17.8 |
| 240 | 22.4 |
| 320 | 25.6 |
| 360 | 26.1 |

Secondary voltages exceeding 10 and 26 kV were attained with primary currents of about 80 and 360 amp·turns, respectively.

EXAMPLE 4

An 80 mm high cylindrical core with the dimension given in Example 1 was prepared and heat-treated at 350° C. for 2 hours. After the heat-treatment, an air-gap was introduced along the cylinder axis by cutting-off part of the core. The primary and secondary coils were wound on the metallic section of the core. The rest of the core-coil assembly was substantially identical to that of Example 1. The resultant secondary voltage-versus-primary current is set forth below in Table IV:

TABLE IV

| Primary Current (amp-turn) | Secondary Voltage (k V) |
|---|---|
| 40 | 4.9 |
| 80 | 9.6 |
| 120 | 14.4 |
| 160 | 19.4 |
| 260 | 22.5 |
| 240 | 26.3 |
| 260 | 27.3 |

Secondary voltages exceeding 14 and 27 kV were obtained with primary currents of about 120 and 260 amp·turns, respectively.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A magnetic core-coil assembly for generating an ignition event in a spark ignition internal combustion system having at least one combustion chamber, comprising a magnetic core that is iron based and further comprises metallic elements including nickel and cobalt, glass forming elements including boron and carbon, and semi-metallic elements, including silicon, said core being fabricated by heat treating an amorphous magnetic alloy and having a primary coil for low voltage excitation and a secondary coil for a high voltage output to be fed to a spark plug, said core-coil assembly having the capability of (i) generating a high voltage in the secondary coil within a short period of time following excitation thereof, and (ii) sensing spark ignition conditions in the combustion chamber to control the ignition event.

2. A magnetic core-coil assembly as recited in claim 1, wherein the magnetic core comprises segmented cores.

3. A magnetic core-coil assembly as recited in claim 1, wherein the output voltage in the secondary coil reaches more than 10 kV with a primary current of less than about 120 amp·turns and more than 20 kV with a primary current of 200 to 300 amp·turns within 25 to 100 $\mu$sec.

4. A magnetic core-coil assembly as recited in claim 1, wherein the magnetic core is non-gapped.

5. A magnetic core-coil assembly as recited in claim 1, wherein the magnetic core is gapped.

6. A magnetic core-coil assembly as recited in claim 4, wherein the magnetic core is heat-treated at a temperature near the alloy's crystallization temperature and partially crystallized.

7. A magnetic core-coil assembly as recited in claim 5, wherein the magnetic core is heat-treated below the alloy's crystallization temperature and, upon completion of the heat treatment, remains substantially in an amorphous state.

* * * * *